US005276597A

United States Patent [19]

Herst et al.

[11] Patent Number: 5,276,597

[45] Date of Patent: Jan. 4, 1994

[54] CONFIGURABLE FURNITURE INTEGRATED AMBIENT LIGHTING SYSTEM AND METHOD

[75] Inventors: Douglas J. Herst, Ross; Utkan Salman, Emeryville, both of Calif.

[73] Assignee: Peerless Lighting Corporation, Berkeley, Calif.

[21] Appl. No.: 714,145

[22] Filed: Jun. 11, 1991

[51] Int. Cl.[5] ..... F21S 3/00

[52] U.S. Cl. ..... 362/225; 362/226; 362/296; 362/414; 362/431

[58] Field of Search ..... 362/33, 226, 225, 296, 362/396, 431, 413, 414, 410, 223, 217, 437

[56] References Cited

U.S. PATENT DOCUMENTS

| | | | |
|---|---|---|---|
| 1,713,509 | 5/1929 | Bowen | 362/414 |
| 1,743,535 | 1/1930 | Edmondson | 362/414 |
| 1,919,114 | 7/1933 | Ley | 362/413 |
| 2,311,986 | 2/1943 | Henschel | 362/410 |
| 2,732,487 | 1/1956 | Crider | 362/410 |
| 3,141,719 | 7/1964 | Moore | 362/217 |
| 3,851,166 | 11/1974 | Kohler | 362/396 |
| 4,228,489 | 10/1980 | Martin | 362/410 |
| 4,363,084 | 12/1982 | Dimiceli | 362/431 |
| 4,420,798 | 12/1983 | Herst et al. . | |
| 4,796,162 | 1/1989 | Krogsrud | 362/33 |
| 5,032,958 | 7/1991 | Harwood | 362/217 |
| 5,091,834 | 2/1992 | Kao et al. | 362/410 |

OTHER PUBLICATIONS

ERCO Lighting catalog, Program 1989/91, pp. 96–97, publication date unknown.

*Primary Examiner*—Carroll B. Dority

*Attorney, Agent, or Firm*—Donald L. Beeson

[57] ABSTRACT

A configurable furniture integrated lighting system has a plurality of interchangeable symmetric and asymmetric fixture heads for indirect lighting and a plurality of different supporting structures for supporting any one of the fixture heads at a predetermined mounting height from a variety of different support surfaces associated with the furniture system, including floor level support surfaces, desk top surfaces, book shelf surfaces, and binder bins. The described invention can be mounted virtually anywhere along the partition walls of almost any open office arrangement, with different alignments with respect to the walls being possible. Free-standing fixtures can additionally be placed as required to achieve an optimum ambient lighting distribution.

20 Claims, 8 Drawing Sheets

CONFIGURABLE FURNITURE INTEGRATED AMBIENT LIGHTING SYSTEM AND METHOD

BACKGROUND OF THE INVENTION

The present invention generally relates to office lighting; it particularly relates to providing and positioning sources of ambient lighting in an open office having office systems furniture.

Modular systems furniture are widely used to create open office arrangements that are both flexible and efficient. A modular office system will typically include partition walls for creating suitably private office spaces or other work areas. However, much more than a desk surrounded by partitions, a modern office furniture system provides a coordinated set of elements that can be aesthetically integrated into an appropriate layout of offices and connecting spaces which can include, at the option of the designer, a variety a working surfaces, counter tops, book selves, storage cabinets, binders bins, and the like. As business needs change, the open office normally can be added to or reconfigured at a relatively modest cost.

However, the very flexibility in placing and configuring modular office systems furniture leads to problems in terms of the quality of the open office's ambient lighting environment. Conventional sources of ambient lighting are relatively inflexible in terms of their placement. Thus, a layout of modular offices and connecting areas optimized to meet particular business needs may produce a poor lighting environment, that is, an environment where the ambient lighting (as opposed to specific task lighting) is not well distributed in relation to the work spaces of the open office. For example, ambient light might be produced in a typical office by direct lighting fixtures, such as conventional 2 foot by 4 foot recessed parabolic troffers evenly distributed about an overhead ceiling surface. Modular offices placed between fixtures would likely be poorly lit as compared to modular office placed directly underneath a lighting fixture. Where the office ambient lighting is provided by indirect lighting fixtures, the situation is improved since indirect light tends to be more evenly distributed. Nonetheless, the quality of the lighting environment in the modular office will still depend to a large degree on the placement of the systems furniture in relation to the normally fixed placement of the sources of indirect lighting.

While moveable indirect lighting fixtures have been devised for use in open offices, such fixtures are very limited as to where they can be placed. Such existing moveable fixtures include floor standing indirect HID and fluorescent fixtures and indirect HID and fluorescent fixtures designed to simply rest on top of a furniture system's binder bin.

The above-mentioned deficiencies of conventional sources of ambient lighting in the open office environment can have a great impact on the quality of the work environment and employee efficiency. An adequate and even distribution of ambient lighting which does not produce glare plays an important role in preventing employee fatigue, eye strain, and other health problems related to poor lighting. The present invention overcomes these problems by making it possible to provide an open office with optimally distributed ambient lighting from indirect lighting sources. Specifically, the present invention provides a furniture integrated ambient lighting system that is fully configurable within the modular office furniture system for which it is designed. Using the furniture integrated ambient lighting system of the invention, sources of indirect light can be easily and interchangeably placed in a wide variety of locations on or about the modular office furniture system for providing an ambient light distribution that is specifically tailored to a particular modular office layout. The result is the efficient illumination of all work areas and other areas such as connecting walkways, meeting areas and the like. Moreover, the below described invention permits the ambient lighting of an open office to be easily changed with changes in the office configuration.

Thus, the ambient lighting system of the invention overcomes the present inflexibility of the above-described conventional direct and indirect lighting systems; it also provides a system that can be fully integrated into the furniture system and made to aesthetically compliment the system's structural elements. Furthermore, the elements of the lighting system are portable, and not architectural fixtures. Thus, ownership of the fixtures may be with the tenant who can move them from location to location and depreciate them over a shorter depreciation period.

SUMMARY OF THE INVENTION

Briefly, the furniture integrated ambient lighting system of the invention provides for a plurality of fixture heads for indirect lighting which are detachably mountable to and fully interchangeable with a plurality of different mounting structures for mounting the fixture heads from different support surfaces associated with a modular office furniture system. The mounting structures provide variously for mounting the detachable fixture heads from a low floor level surface, from an intermediate level surface such as a desk top or counter top, or from an elevated surface, such as the top of a binder bin, all using interchangeable parts which permit the fixture heads to be easily installed at a predetermined mounting height near or above eye level. While it is contemplated, indeed preferred, that all fixture heads will be in the same mounting plane, it is understood that, within a given open office plan, the mounting structures could, if desired, provide the flexibility of mounting the fixture heads at varied mounting heights.

The interchangeable mounting structures of the invention include an upright stem element for providing the desired elevation for the fixture head, and a yoke which laterally extend from the stem to detachably support a selected one of the interchangeable fixture heads. The mounting structures additionally include stem support means for holding the stem element in an upright position from a variety of support surfaces and structures associated with a modular office furniture system. Examples of the stem support means include flat support bases of suitable dimensions for supporting fixture heads from a floor level surface or, at the other extreme, from the top of a high binder bin. Another example includes clamping structures for clamping the stem to the edge of a desk top or elevated counter top. Yet another stem support means might include cleats on the stem for hanging the stem element to slotted joiner strips connecting adjacent wall partition panels. The wide variety of support structures will permit the fixture heads to be located virtually anywhere within an arrangement of systems furniture to achieve an optimum ambient lighting environment.

The stem of the mounting structure will preferably have a uniform cross-section and will be an extruded part cut to a desired length which provides a desired elevation. Attachment means, such as threaded ends of an extruded hole, are provided in the top and the bottom of the extruded stem such that the support yoke for the fixture head can removably be attached to one end of the stem, and the stem support attached to the other. Separate attachments, such as screw attachments, are provided in the yoke for detachably mounting the fixture head to the yoke. Thus, the fixture head and the parts of the mounting structure for the fixture head can be easily shipped and stored in a disassembled state. Also, the extruded stem can be conveniently cut to length at the factory, or even at the installation site, to meet varied requirements of a particular modular office installation. It is also a feature of the preferred embodiment of the invention that the yoke and stem of the mounting structure include wire chases to permit out of sight wiring of the fixture head.

In a further aspect of the invention, the interchangeable fixture heads are provided in both a symmetric and asymmetric version. Specifically, each fixture head will have a characteristic geometric shape and will include a bottom support surface shaped to substantially match the characteristic shape of the yoke: when the fixture head is mounted to the yoke it is mounted to the yoke along and in a mating relationship with its bottom support surface. In the symmetric version of the fixture head, the head extends symmetrically about its bottom support surface and thus will lie symmetrically about the yoke. In the asymmetric version, the fixture head extends asymmetrically about its bottom support surface such that its relation to the yoke is asymmetric. This will permit different placement opportunities for the fixture heads such as placing symmetric heads in unbounded spaces while placing asymmetric heads next to vertical wall surfaces.

It is a further feature of the invention that the yoke can be made to extend laterally outward and in asymmetric relation to the upright stem of the mounting structure such that the mounting structure can be reversed by 180 degrees to obtain a different alignment of fixtures. For example, one or more symmetric fixture heads can be centered over a wall partition of a furniture system such that the fixtures straddle two work areas, or by reversing the direction of the yoke, the fixtures can for reasons of aesthetic design be aligned in off-set relation to the wall partitions such that the fixture heads are located within the perimeter of a defined office or connecting area. It will be seen that the unique mounting structures of the invention provide for maximum flexibility in locating the fixture heads in and about the modular office furniture system for not only achieving desired ambient light distributions but also for realizing aesthetic goals.

Another aspect of the invention is that the housing of the fixture head can be fabricated in two sections which are joined together with a reveal along the joined edges of the housing sections. The sectional construction of the housing permits the housing parts to be fabricated from thinner walled extrusions and also importantly permits the symmetric and asymmetric versions of the fixture head to be readily assembled by simply selecting and joining, as required, two identical halves or two non-identical halves of the housing. The necessary inventory of parts for constructing symmetric and asymmetric fixture heads will thereby be greatly reduced since only two standard parts will need to be stocked for producing either version of the fixture head.

Therefore, it can be seen that it is a primary object of the invention to provide a configurable furniture integrated ambient lighting system which can be used to optimize the distribution of ambient lighting in an open office environment by providing sources of indirect lighting that are readily located at a wide variety of positions in or about modular office systems furniture. In accordance with the invention, the quality of indirect ambient lighting in the open office can be greatly improved. This will include the ability to improve brightness uniformity on overhead ceiling surfaces thereby reducing glare producing contrast brightness. Other objects of the invention will be apparent from the following specification and claims.

DESCRIPTION OF THE DRAWINGS

FIG. 3 is a side elevational view of a fixture head mounted adjacent a partition wall to a desktop surface as shown in FIG. 2B, except with the fixture head being a symmetric fixture head and having a different centered alignment with respect to the partition wall.

DETAILED DESCRIPTION OF THE ILLUSTRATED EMBODIMENT

Figure 1:
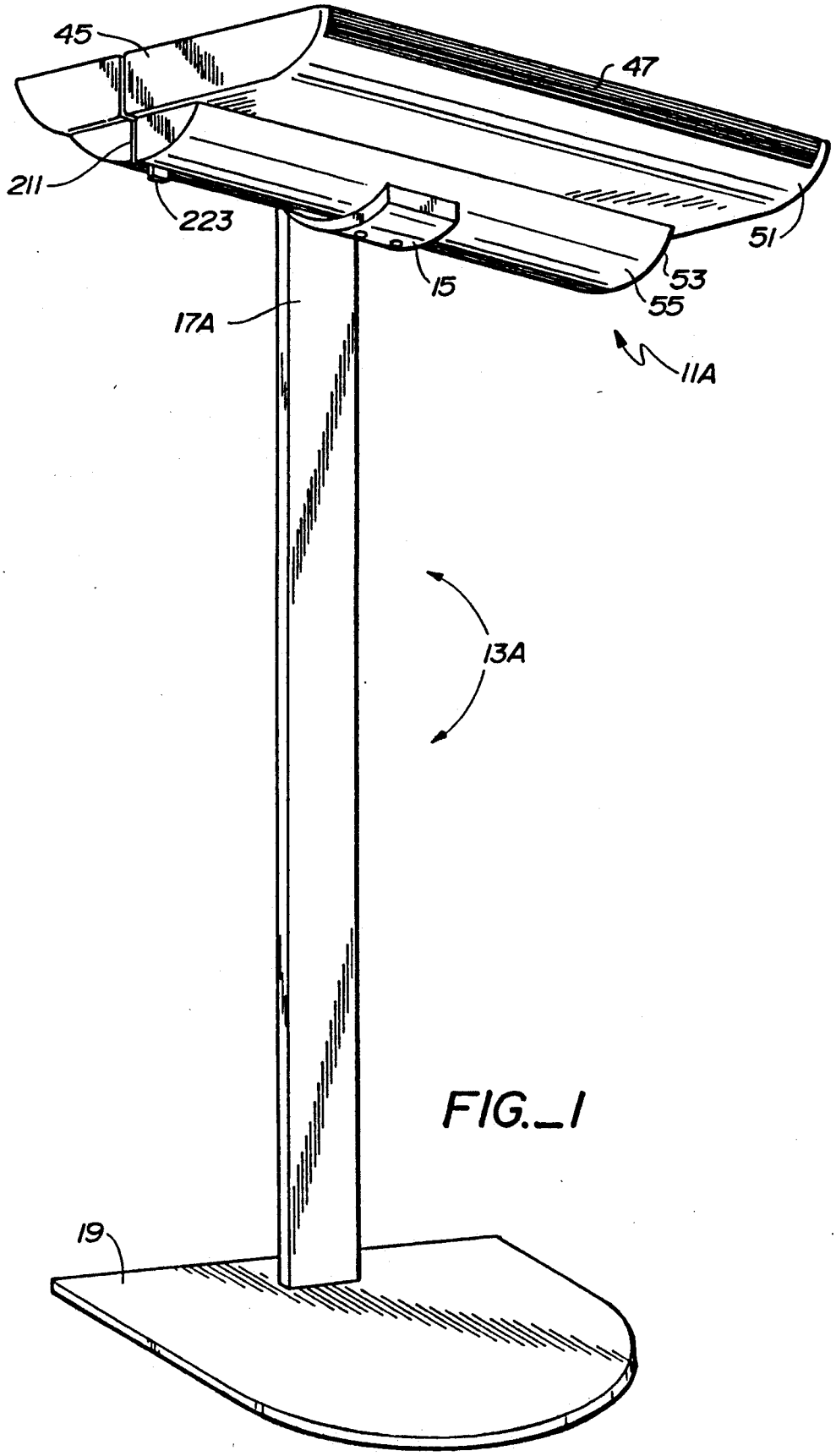
FIG. 1 is a bottom perspective view of a floor mounted fixture head of a furniture integrated lighting system according to the invention.

Referring now to the drawings, FIGS. 1 and 2 show the basic ambient lighting system of the invention mounted to different height surfaces associated with a modular office furniture system. A plurality of fixture heads 11A, 11B, 11C, 11D, 11E for indirect lighting are supported by a plurality of mounting structures 13A, 13B, 13C, 13D, 13E, each of which includes a yoke 15A, 15B, 15C, 15D, 15E, an upright stem 17A, 17B, 17C, 17D, 17E, and a stem support means, the structure of which depends on the nature of the surface from which the fixture head is supported. As shown in FIG. 2, by providing suitable length stems 17 all fixture heads are preferably supported at the same mounting height. Generally speaking, the mounting heights of the fixture heads can be said to define an ambient lighting mounting plane as denoted in FIG. 2 by the letter "A".

Figure 2C:
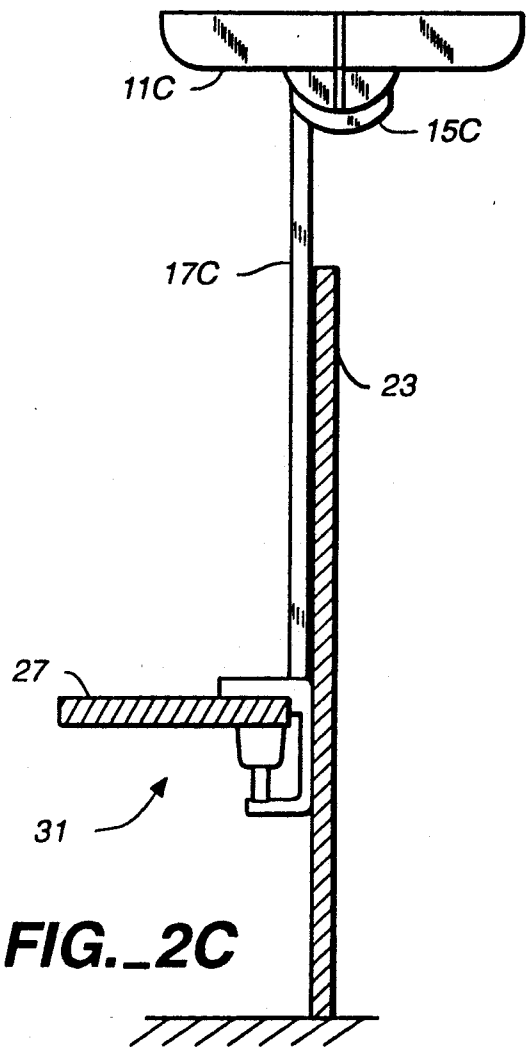
FIG. 2A is a side elevational view of the floor mounted fixture head and mounting structure of FIG. 1.
FIG. 2B is a side elevational view of an interchangeable fixture head as is shown in FIGS. 1 and 2A mounted adjacent a partition wall to a desktop of a furniture system such that the fixture head is aligned within the perimeter of the partition wall and such that the mounting height of the fixture head is the same as the fixture head of FIG. 2A.
FIG. 2D is a side elevational view of an interchangeable asymmetric fixture head as shown in FIG. 2A mounted adjacent a partition wall to a shelf, such as a book shelf, of a furniture system and wherein the fixture head is aligned within the perimeter of the partition wall.
FIG. 2E is a side elevational view of an interchangeable asymmetric fixture head as shown in FIG. 2A and mounting structure therefor for a mounting the fixture from the top of a binder bin of a furniture system.
Figure 2B:
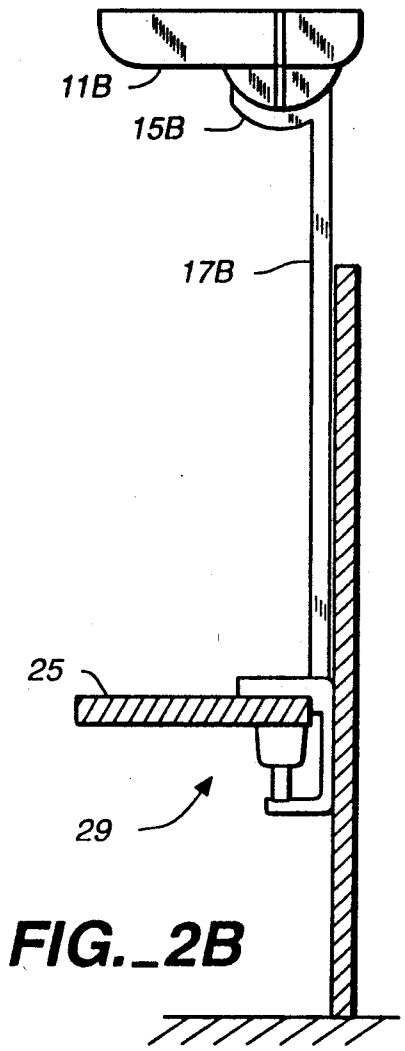
Figure 2A:
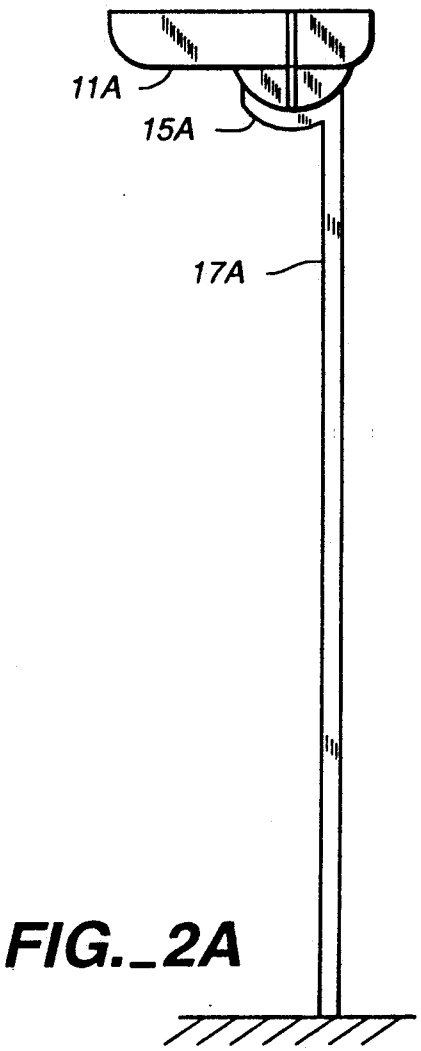
Figure 2E:
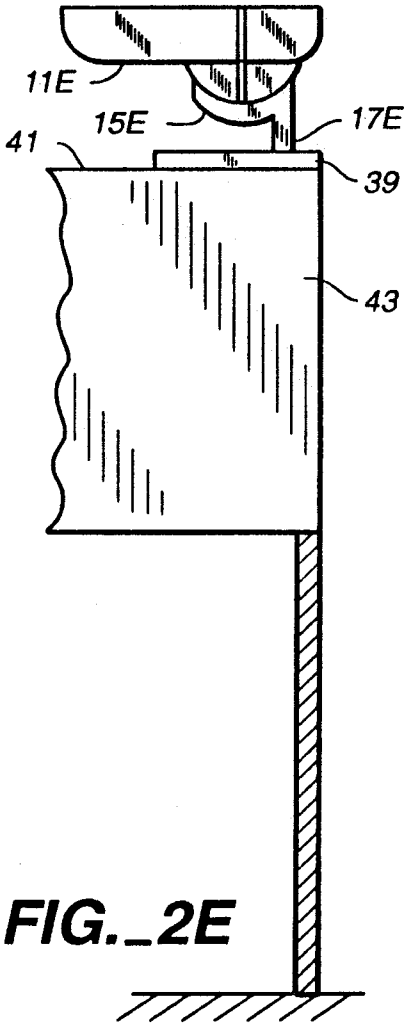
Figure 2D:
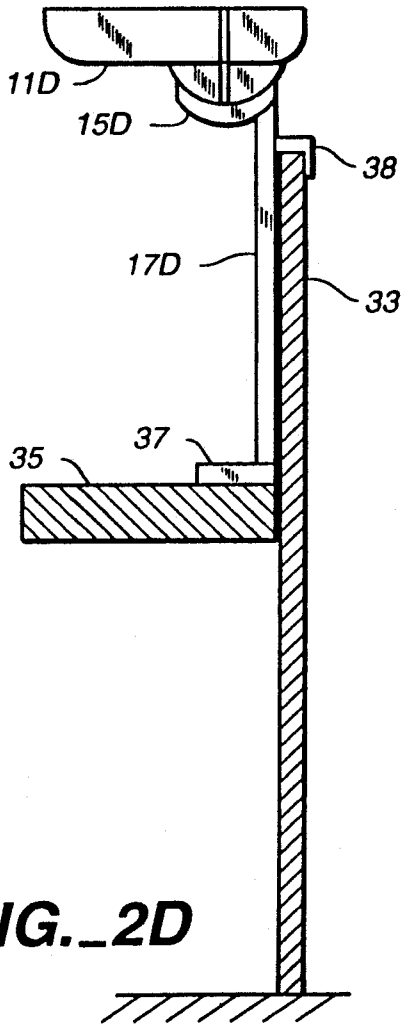

FIGS. 1 and 2A more specifically illustrate a fixture head 11A supported from a floor level surface on a full height stem 17A by a stem support means consisting of a relatively large flat support stand 19; in FIGS. 2B and 2C the fixture heads 11B and 11C are supported next to partition walls 21 and 23 on intermediate height stems 17B and 17C from first intermediate height desk top surfaces 25 and 27 by means of clamping structures 29 and 31 that clamp to the edge of the desk tops; FIG. 2D shows a fixture head 11D supported next to a partition wall 33 from a second intermediate height bookshelf surface 35 on a second intermediate height stem 17D by means of a flat base 37 and partition retaining hook 38; and in FIG. 2E the fixture head 11E which has a flat stand 39 is freestanding on a short stem 17E on the high support surface 41 of a binder bin 43. It is understood that the interchangeable fixture heads 11 could be supported from other types of surfaces associated with office systems furniture in a manner not specifically illustrated in the drawings. For example, the stem 17 of the mounting structure could be provided with a vertical row of mounting cleats adapted to be inserted in corresponding slots in vertical joiner strips connecting adjacent wall partition panels. Other stem support means could be devised to fit particular mounting criteria.

It is further understood that while in FIG. 2 the fixture heads are illustrated as being mounted at the same mounting height, it is possible within the scope of the invention to mount the fixture heads at different mounting heights. Generally speaking, the mounting height of each fixture head will be at least at eye level and preferably above eye level. The heights of the fixture heads, even if at varied heights, will generally define a horizontal ambient lighting mounting plane, such as mounting plane A in FIG. 2, within which the fixture heads can be positioned and repositioned for achieving an optimum ambient light distribution pattern.

The interchangeable fixture heads 11 each have a generally pan-shaped opaque housing 45 of a characteristic rectangular geometry. A visible side lens 47 extends along the top of the housing side wall 51 to provide a low brightness element visible to employees within the open offices. The psychological benefits of providing a source of observable low brightness in an indirect lighting environment are described in U.S. Pat. No. 4,390,930. The housing also includes a shaped channel portion 53 which protrudes from and longitudinally extends along the bottom of the housing to provide a bottom support surface 55 by which the fixture head is supported on the yoke 15 of on of plurality of the mounting structures. As can be seen, both the yoke and the bottom surface of the fixture head's channel portion have corresponding curved shapes such that they nest together when the fixture head engages the yoke. As hereinafter described, attachment means are provided for easily securing the fixture head to and releasing it from the yoke when a furniture integrated lighting system is assembled and disassembled.

It is noted that two versions of the fixture heads 11 are illustrated in FIG. 2: an asymmetric version that is asymmetric about the channel portion 53 of the housing as shown in FIGS. 2A, 2B, 2D, and 2E; and a symmetric version that is symmetric about the housing's bottom channel portion as shown in FIG. 2C. It is also noted that, in the illustrated embodiment, the yoke 15 is seen to laterally extend to the side of the stem 17 such that the center of the yoke is offset in relation to the stem axis. By providing a symmetric and asymmetric version of the fixture head and an offset yoke and stem configuration as described and shown, a wide variety of mounting configurations can be created within the plan of an office furniture system.

Figure 3C:
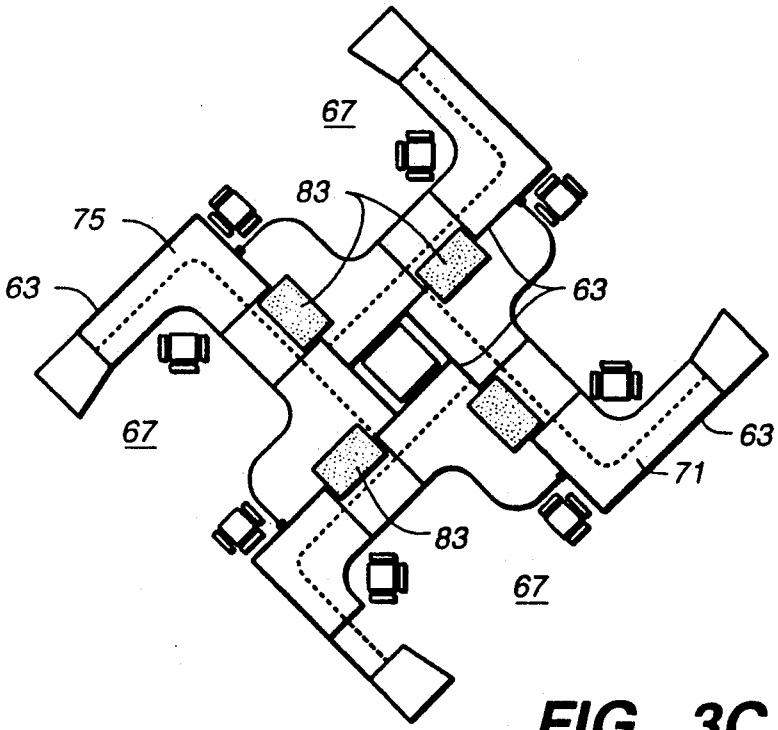
FIG. 3C is a schematic plan view showing a third example of fixture head placements for a furniture integrated lighting system in accordance with the invention.
Figure 3B:
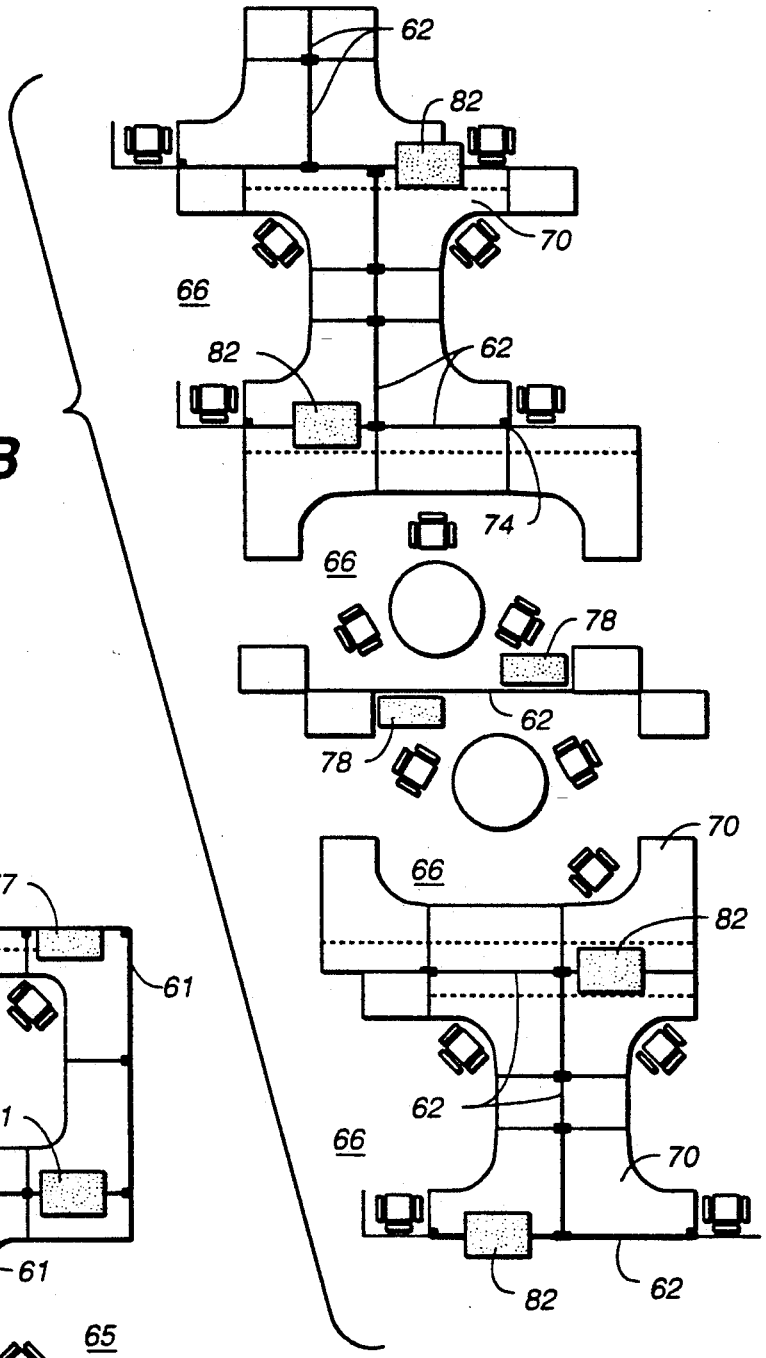
FIG. 3B is a schematic plan view showing a second example of fixture head placements for a furniture integrated lighting system in accordance with the invention.
Figure 3A:
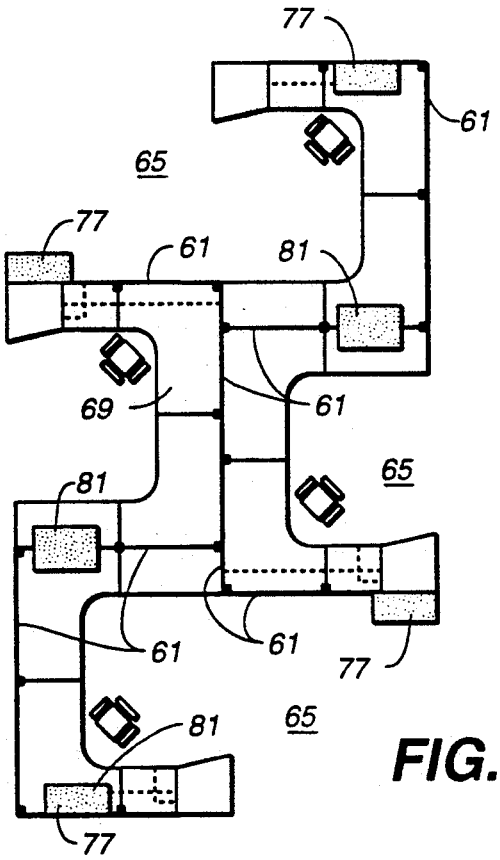
FIG. 3A is a schematic plan view showing an example of fixture head placements for a furniture integrated lighting system in accordance with the invention.

Examples of such mounting configurations are illustrated in FIG. 3. Specifically, three different basic floor plans are separately shown in FIGS. 3A, 3B, and 3C for an open office arrangement formed by partition walls 61, 62, 63 and having, among other things, surrounding floor level surfaces 65, 66, 67, desk top surfaces 69, 70, 71 and book shelf height surfaces 74, 75. Possible configurations of fixture heads include placement of the fixture heads within the perimeter of the partition wall as is the case with fixture heads 77 and 78 in FIGS. 3A and 3B, or centering the fixture heads over the partition walls so that the fixture heads span adjacent work areas, such as illustrated in connection with fixture heads 81, 82, 83 in all three floor plans. Alignment of the fixture heads within the perimeter of the partition walls or on center with the walls can be achieved by simply reversing the stem and yoke assembly as illustrated in FIGS. 2B and 2C.

As above described, by interchanging mounting structures and fixture heads, the fixture heads can be mounted to a variety of different height support surfaces adjacent the wall partitions. Thus, as can be seen in FIG. 3, the fixture heads can be mounted virtually anywhere along the length of any partition wall regardless of adjacent structure. This includes mounting a fixture head from an adjacent floor surface, an adjacent desk top surface, or from a high adjacent book shelf or binder bin surface. Whatever the case, the fixture heads can be distributed about the wall partitions to produce the best possible distribution of ambient lighting within the open office.

Free-standing fixture heads can additionally be distributed about the furniture system as required using a mounting structure as shown in FIG. 2A. Also, using the asymmetric version of the fixture head, such free-standing fixtures can be placed so that the mounting structure and fixture head are substantially flush against a vertical wall.

Figure 4:
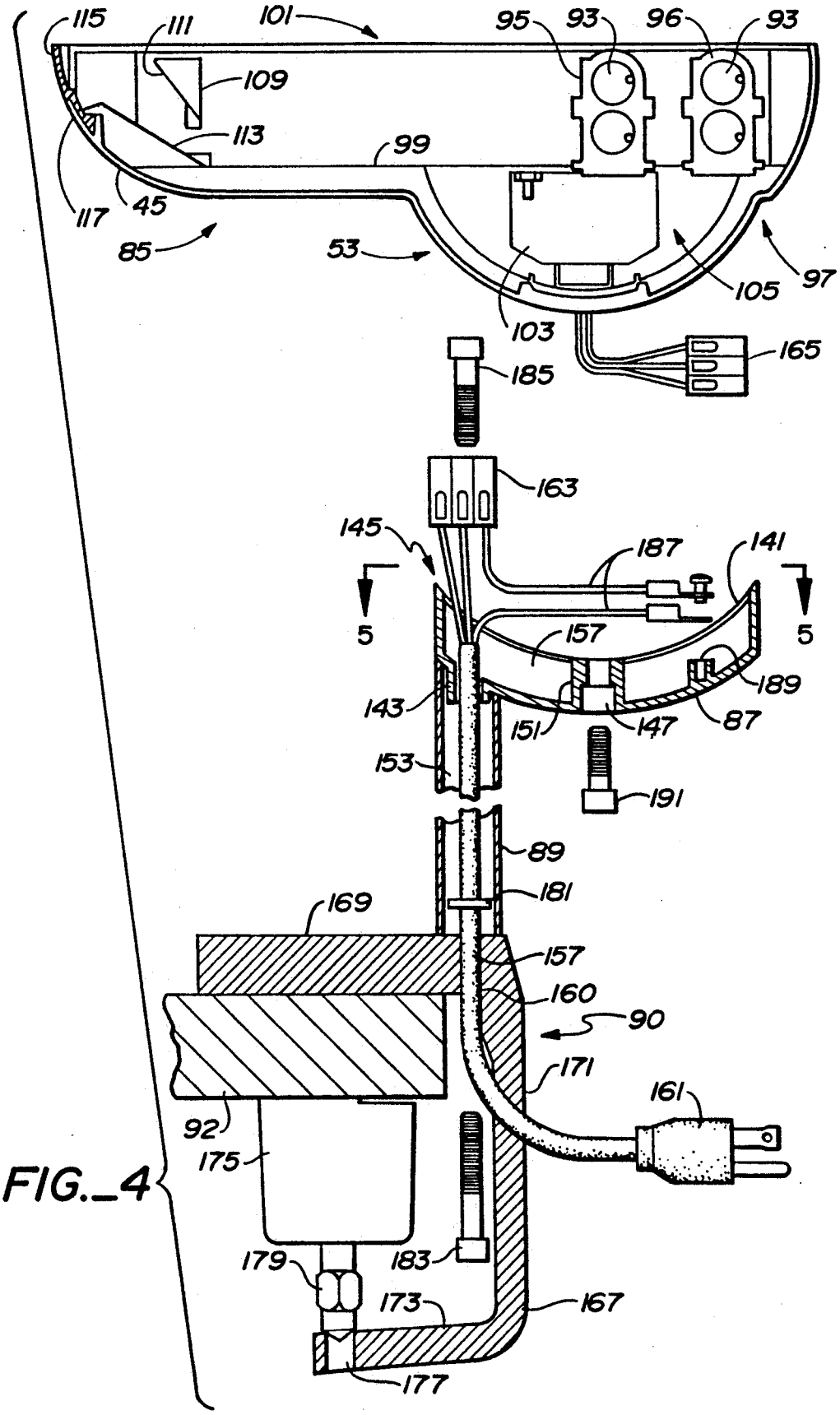
FIG. 4 is a cross-sectional side elevational view of a mounting structure and detachable fixture head of a furniture integrated lighting system in accordance with the invention generally taken along section lines 4—4 in FIG. 7.
Figure 5:
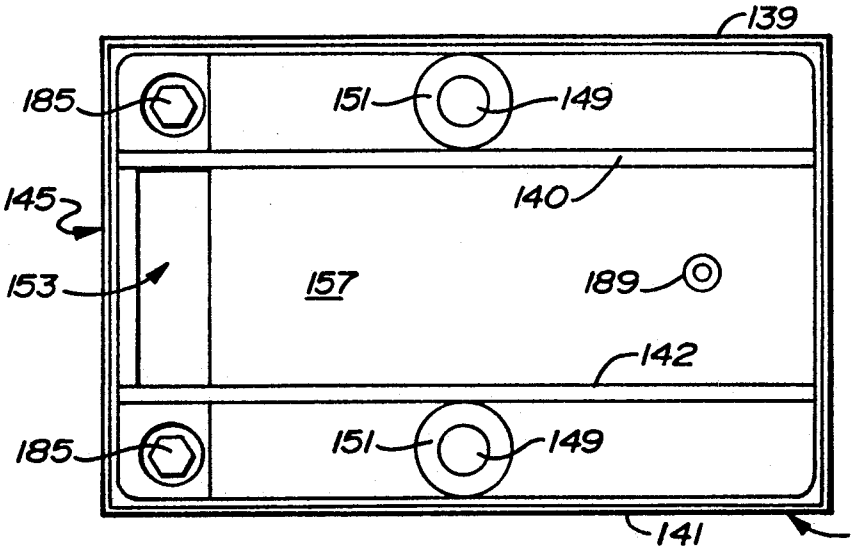
FIG. 5 is a top plan view of the yoke of the mounting structure shown in FIG. 4.
Figure 6:
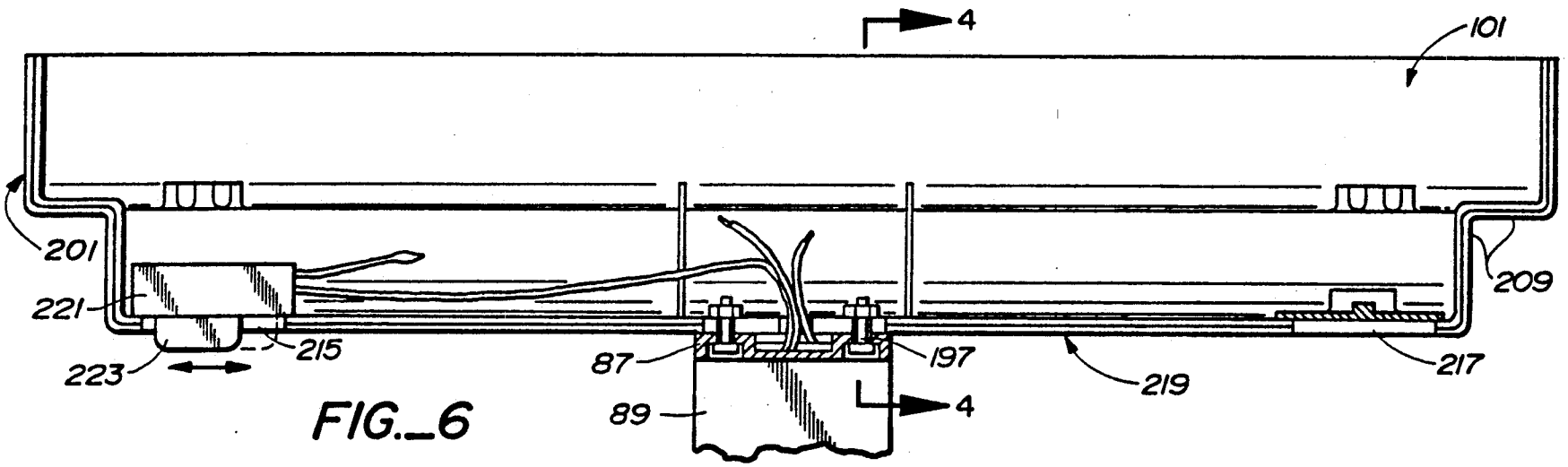
FIG. 6 is a cross-sectional front elevational view of a fixture head attached to the yoke and stem of a mounting structure such as shown in FIG. 4.
Figure 7:
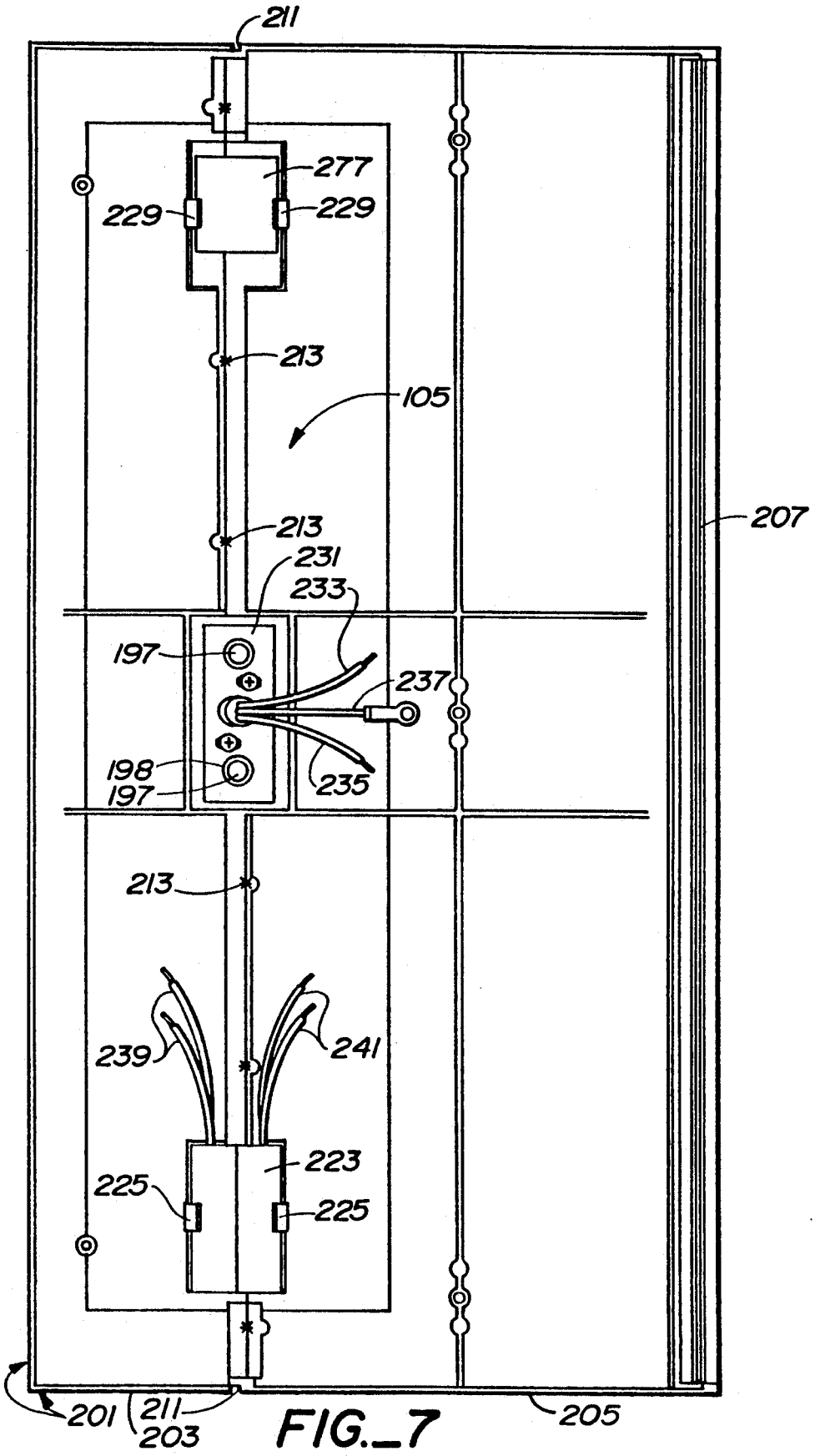
FIG. 7 is a top plan view of an asymmetric fixture head with the bottom reflector assembly removed.

FIGS. 4–8 show a fixture head and a selected mounting structure in greater detail. In FIG. 4 an asymmetric fixture head 85 is shown in connection with a mounting structure comprised of yoke 87, stem 89, and a base clamp structure 87 for mounting the fixture head to the edge of a desk top 89. FIG. 5 shows further detail of the yoke, and FIGS. 6 and 7 show further detail of the fixture head.

As shown in FIG. 4, the fixture head housing 91, in this case an asymmetric housing, contains a light source in the form of two high intensity discharge lamps 93, suitably Biax lamps, plugged into two closely adjacent lamp sockets 95, 96 mounted near the short side 97 of the housing. The lamp sockets are physically attached to reflector 99 which extends over the bottom of the housing and which reflects source light up through the housing's top opening 101. The lamp ballast 103 is physically attached by suitable pan screws to the reverse side of the bottom reflector 99 so that the reflector, ballast, and lamp sockets form an easily installable subassembly. The ballast is seen to be positioned on this subassembly so that it extends down into the bottom cavity 105 formed by the housing bottom channel 107.

The fixture head housing 91 further contains a secondary reflector structure 109 having a diffuse reflector surface 111, which in conjunction with the angled side reflector portion 11 of the bottom reflector provides an indirect light path between the lamps 93 and the visible side lens element 11 mounted to the top of the housing's side wall 117. The secondary reflector structure, which extends the full length of the housing and which shields the side lens element from receiving light directly from the light source, permits greater control over the level and uniformity brightness induced in the side lens by the light source.

Figure 8:
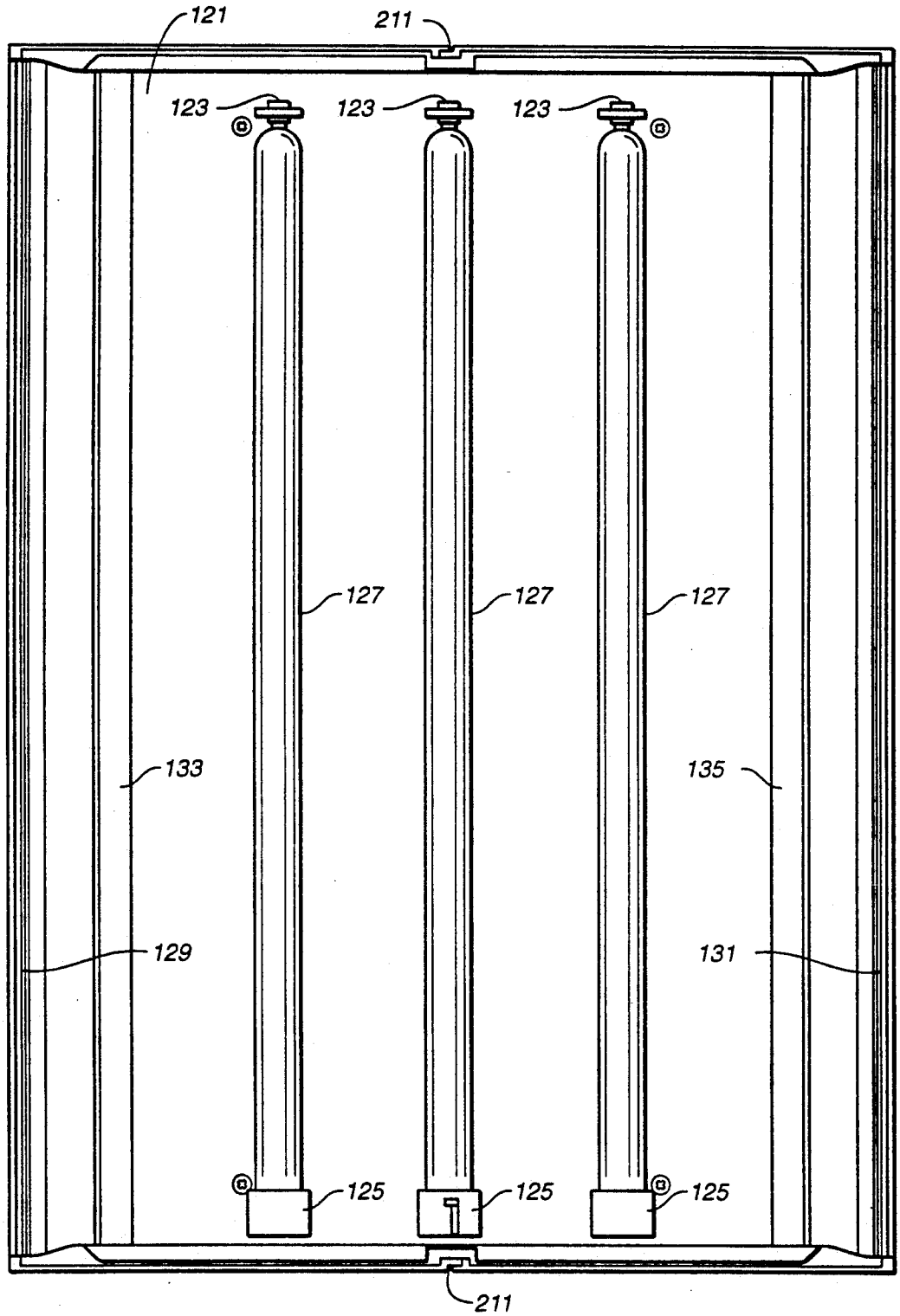
FIG. 8 is a top plan view of a symmetric fixture head showing the bottom reflector assembly including the placement of light sockets and lamps.

FIG. 8 of the drawing shows, in a top plan view, a symmetric version of the fixture head shown in FIG. 4. The fixture head in FIG. 8 is in most respects identical to the fixture head of FIG. 4 except for the symmetry of the fixture and the fact that the FIG. 8 fixture is a three lamp fixture instead of a two lamp fixture and that the lamps 127 are symmetrically mounted over the larger bottom reflector 121 rather than off center as shown in FIG. 4. FIG. 8 further shows lamp retention brackets 123 mounted to the bottom reflector opposite the lamp sockets 125 for holding the free end of the U-shaped high discharge lamps 127. Similar retention brackets suitably placed would be used in connection with the FIG. 4 asymmetric embodiment. Also, due to the symmetry of the FIG. 8 fixture head, the FIG. 8 fixture head, unlike the FIG. 4 fixture head, has two visible lens elements 129, 131, one mounted to either side of the fixture housing, and two secondary lens structures 133, 135 extending the length of the fixture housing to ensure that both lens elements receive indirect source light only.

Referring again to FIG. 4 and to FIG. 5 the yoke 87 of the mounting structure has a curved shape with opposed side walls 139, 140 and interior walls 140, 142, each of which has curved top edges which provide cradling surfaces 141 for the fixture head. The bottom surface 107 of the channel and the cradling surfaces of the yoke should have the same radius of curvature so that they closely nest together when the fixture head is placed on the yoke. The yoke additionally includes both a neck portion 143 and screw attachment holes at its stem support end 145 for securing the yoke to the top of the stem 89. Additional screw holes 149 provided in bosses 151 formed in the middle of the yoke receive exterior accessible head attachment screws 191 for releasably attaching the fixture head to the yoke.

The mounting structure stem 89 is preferably an extruded part having a uniform cross section including a wire chase 153 and internal extruded longitudinal ribs (not shown), the ends of which are threaded to permit screw attachment of the yoke to the top of the stem through the yoke stem attachment holes; similar screw attachment means are provided at the other end of the stem for attaching a bottom support structure, such as the clamp shown in FIG. 4, to the bottom of the stem.

As shown in FIG. 4, the wire chase 153 in the stem communicates through the neck of the yoke to a wire chase area 157 in the yoke to permit wiring of the fixture head through the stem and yoke. Specifically, the fixture head is electrically wired by means of an insulated three-wire cord 159 having a plug end 161 extending from the bottom of the stem, and a quick connect end 163 for connecting to a corresponding quick connect plug 165 extending from the bottom channel 107 of the fixture housing.

The stem support means of the stem structure shown in FIG. 4 includes a C-shaped clamp body 167 having a top plate 169 which rests on the desk top 89, a downwardly extending side wall 171 to extend the clamp down behind the desk top, and a bottom leg 173 extending inwardly from below the desk top. The clamp body should be suitably massive and of a suitably heavy material to provide a weighted base that can hold the weight of the fixture head at the top of the support stem.

The clamping force is provided at the bottom of the desk top by means of a relatively large clamping block 175 which is retractably engaged against a pivot hole 177 in the bottom leg of the clamp body by means of a threaded turn bolt element 179. The clamping surface of the clamping block should be sufficiently large to prevent damage to the desk top. Also, the clamp body should be suitably sized, and particularly the bottom leg of the clamp body should be of suitable length, to accommodate any wire channels that may exist under the desk top surface.

The ease of on-site assembly of the fixture head to the mounting structure of the invention can be described with further reference to the FIG. 4 embodiment. The quick connect end 163 of the electrical cord 159, without the quick connect housing attached, can first be threaded through a suitable wire hole 160 drilled in the top plate 169 of the clamp body 167. After a stabilizing washer 181 is placed over the quick connect end of the cord, the cord can then be threaded through the wire chase 153 of the stem 89, after which the bottom of the stem can then be attached to the top plate of the clamp body by means of base attachment screws 183 inserted through suitable screw holes (not shown) formed on either side of the wire hole in the top plate of the clamp body. The quick connect end of the cord can then be threaded through the neck 143 of the yoke as the yoke's neck is inserted into the top opening of the stem, whereupon the yoke is screwed to the stem by means of yoke attachment screws 185. It should be noted that the cord is preferably pulled through the neck of the yoke before the yoke is screwed to the stem. This will prevent the end of the cord from becoming jammed in the stem's wire chase against the yoke's neck.

Once the base clamp, stem and yoke have been assembled with the cord threaded through it, the plastic housing of the quick connect can then be snapped onto the quick connect end of the cord, the quick connect end of the cord connected to the connecting plug 165 from the lamp ballast, and the ground wire 187 attached to the housing at 189. With the loose wiring and connectors nestled in the yoke's wire chase area 157, the fixture head can thereafter be screwed onto the yoke by means of head attachment screws 191.

FIGS. 6 and 7 further illustrate the manner of attaching the yoke to the bottom of the fixture housing and the wiring of the housing ballast and internal slide switch. FIGS. 6 and 7 also illustrate the nature of the sectional construction of the housing which permits asymmetric and symmetric housings to be produced from an inventory of only two cast aluminum parts.

With reference FIGS. 6 and 7, an asymmetric housing 201 is fabricated from a first housing section 203 and a second housing section 205, with the second housing section which supports the side lens element 207 having a wider dimension than the first housing section. The two sections ar joined along identical mating interior stepped edges 209 which are formed to produce a reveal 211 along the entire visible portion of the joined edges. (FIG. 1, for example, shows the reveal in the end of the housing.) Such a reveal construction permits the first and second sections of the housing to be joined together, such as by tack welds 213 shown in FIG. 7, such that otherwise apparent and unsightly mismatches in structure at the abutting edges of the housing sections will be hidden from view. Unique advantage is also taken of the reveal construction by providing unobtrusive slide switch slots 215, 217 in the reveal at opposite ends of the housing bottom channel 219. A slide switch 221 having a thin slide tab 223 that accessibly projects from the reveal through one of the slots can thus be placed at either end of the channel. The slide switch 221 is held in place by spring clips 225, and the unused slot is covered by a blanking plate 227 which is similarly held in place by spring clips 229.

FIGS. 6 and 7 also generally show the manner of wiring the slide switch 221. Specifically, a three-wire cord having positive and negative wires 233, 235 and ground wire 237, extend through a wire hole in the bottom mounting plate 231 which also receives the head attachment screws 197 which are secured by nuts 198. As would be readily apparent to a person skilled in the art, the slide switch would be wired in series with the ballast and lamp sockets forming part of the reflector sub-assembly. In the case of the two lamp version of the fixture head shown in FIG. 4, a three-position slide switch having two micro switches can be provided for switching both the lamps 93. Thus, the slide tab projecting from the reveal at the bottom of the housing can be moved in a sliding action within the reveal to one of three switch positions for activating or deactivating the luminaire head.

With further reference to FIG. 7, it can be seen that the individual lamp sockets can be wired from different micro switches (not shown) within the slide switch by means of separate wire pairs 239, 241.

The present invention therefore provides an easily assembled, and versatile furniture integrated lighting system without the normal physical constraints as to location normally associated with conventional fixture designs. Although an illustrated embodiment of the invention has been described in considerable detail in the foregoing specification, it is understood that it is not intended that the invention be limited to such detail, except as may be necessitated by the following claims.

What we claim is:

1. A lighting fixture for a configurable ambient lighting system comprising a fixture head having a fixture head housing, said housing having a bottom support surface and a top opening for providing indirect lighting, a mounting structure removably mountable to said fixture head housing bottom support surface, said mounting structure including a stem for vertically positioning said fixture head at a desired mounting height and a laterally extending yoke on said stem for supporting said fixture head, said yoke being formed to receive and supportively conform with the bottom support surface of said fixture head housing when said fixture head is placed thereon, means for releasably securing said fixture head housing to said yoke such that said fixture head and said mounting structure can readily be interchanged with other similarly constructed fixture heads and mounting structures to provide different lighting configurations supportable on different height mounting surfaces.

2. The lighting fixture of claim 1 wherein said yoke laterally extends to one side of said stem to provide an asymmetric support for said fixture head relative said stem.

3. The lighting fixture of claim 1 wherein said fixture head housing has a shallow, pan-shaped geometry.

4. The lighting fixture of claim 3 wherein said shallow, pan-shaped fixture head housing has a bottom wall portion, wherein the bottom support surface of said fixture head housing is a shaped surface on said bottom wall portion, and wherein the yoke of said mounting structure has a shape corresponding to the shape said bottom support surface.

5. The lighting fixture of claim 4 wherein said fixture head housing has a downwardly protruding portion on the bottom wall portion thereof, and wherein the shaped bottom support surface of said fixture head housing is provided by said protruding portion.

6. The lighting fixture of claim 5 wherein said protruding portion has a substantially semi-cylindrical shape to provide a arcuate bottom support surface.

7. The lighting fixture of claim 1 wherein said fixture head housing is a symmetric housing in reference to its bottom support surface to provide symmetrical alignment between said fixture head and the yoke of said mounting structure.

8. The lighting fixture of claim 2 wherein said fixture head housing is a symmetric housing in reference to its bottom support surface to provide symmetrical alignment between said fixture head and the yoke of said mounting structure.

9. The lighting fixture of claim 1 wherein the fixture head housing is an asymmetric housing in reference to its bottom support surface to provide asymmetrical alignment between said fixture head and the yoke of said mounting structure.

10. The lighting fixture of claim 2 wherein the fixture head housing is an asymmetric housing in reference to its bottom support surface to provide asymmetrical alignment between said fixture head and the yoke of said mounting structure.

11. The lighting fixture of claim 1 wherein said fixture head housing and mounting structure have associated electrical wiring internally thereof for providing electrical power to said fixture head and wherein said electrical wiring includes quick connector means for readily connecting the electrical wiring of said fixture head with the wiring of said mounting structure when said fixture head housing is placed directly on the yoke of said mounting structure.

12. The lighting fixture of claim 1 wherein the stem and yoke of said mounting structure have communicating wire chases for wiring said fixture head through said mounting structure.

13. The lighting fixture for a configurable ambient lighting system comprising a fixture head having a shallow, pan-shaped fixture head housing, said housing having a top opening for providing indirect lighting, a bottom wall portion, and a downwardly protruding portion on said bottom wall portion which presents a shaped bottom support surface for said fixture head housing, a mounting structure removably mountable to said fixture head housing bottom support surface, said mounting surface including a stem for vertically positioning said fixture head at a desired mounting height, and a laterally extending yoke on said stem for supporting said fixture head, said yoke being formed to receive and supportively conform with the bottom support surface of said fixture head housing when said fixture head is placed thereon and being sized such that said fixture head covers substantially the entirety of said yoke, and said yoke laterally extending to one side of said stem to provide an asymmetric support for said fixture head relative said stem, and means for releasably securing said fixture head housing to said yoke such that said fixture head and said mounting structure can readily be interchanged with other similarly constructed fixture heads and mounting structures to provide different lighting configurations supportable on different height mounting surfaces.

14. The lighting fixture of claim 13 wherein the protruding portion of said fixture head housing is an elongated protrusion which extends across substantially the entire width of the fixture head housing's bottom wall portion.

15. The lighting fixture of claim 13 wherein the protruding portion of said fixture head housing is centrally disposed on the fixture's head housing's bottom wall portion such that said fixture head symmetrically aligns with the yoke of said mounting structure.

16. The lighting fixture of claim 13 wherein the protruding portion of said fixture head housing is disposed on the fixture head's housing's bottom wall portion in an offset position such that said fixture head asymmetrically aligns with the yoke of said mounting structure.

17. The lighting fixture of claim 13 wherein the yoke and stem of said mounting structure are separate parts, wherein said yoke has a stem end and a neck portion at said stem end, and wherein said stem has a top end formed to receive and hold the neck portion of said yoke.

18. The lighting fixture of claim 13 wherein said means for releasably attaching said fixture head housing directly to the yoke of said mounting structure includes at least one head attachment screw insertable through the bottom of said yoke.

19. A lighting fixture for a configurable ambient lighting system comprising a shallow, pan-shaped fixture head having a top opening for providing indirect lighting, a bottom wall portion, and a substantially semi-cylindrical channel portion protruding from said bottom wall portion so as to present an arcuate bottom support surface for said fixture head, a mounting structure removably mountable to said fixture head housing bottom support surface, said mounting structure including a stem for vertically positioning said fixture head at a desired mounting height, and a laterally extending arcuate yoke on said stem for supporting said fixture head, said yoke receiving and supportively conforming with the bottom support surface of said fixture head when said fixture head is placed thereon and laterally extending to one side of said stem to provide an asymmetric support for said fixture head relative said stem, electrical wiring associated with said fixture head and said mounting structure for providing electrical power to said fixture head, said electrical wiring including quick connector means for readily connecting the electrical wiring of said fixture head with the wiring of said mounting structure when said fixture head is placed in the yoke of said mounting structure means for releasably securing said fixture head to said yoke such that said fixture head and said mounting structure can readily be interchanged with other similarly constructed fixture heads and mounting structures to provide different lighting configurations supportable on different height mounting surfaces.

20. The lighting fixture for a configurable ambient lighting system comprising a fixture head having a fixture head housing, said housing having a bottom support surface and a top opening for providing indirect lighting, a mounting structure removably mountable to said fixture head housing bottom support surface, said mounting structure including a stem for vertically positioning said fixture head at a desired mounting height and a laterally extending yoke on said stem for supporting said fixture head, said yoke being formed to receive and supportively conform with the bottom support surface of said fixture head housing when said fixture head is placed thereon and being sized such that said bottom support surface covers substantially the entirety of said yoke, means for releasably securing said fixture head housing to said yoke such that said fixture head and said mounting structure can readily be interchanged with other similarly constructed fixture heads and mounting structures to provide different lighting configurations supportable on different height mounting surfaces.

* * * * *

UNITED STATES PATENT AND TRADEMARK OFFICE

CERTIFICATE OF CORRECTION

PATENT NO. : 5,276,597
DATED : January 4, 1994
INVENTOR(S) : Herst, Douglas J. and Salman, Utkan It is certified that error appears in the above—identified patent and that said Letters Patent is hereby corrected as shown below:

Col. 7, line 24, "11" should be --113--.

Col. 7, line 27, "11" should be --115--.

Col. 11, line 16, "structure" should be --surface--.

Col. 11, line 44, "fixture's" should be --fixture--.

Col. 11, line 49, "head's" should be --head--.

Col. 11, line 18, "surface" should be --structure--.

Signed and Sealed this

Twenty-fifth Day of October, 1994

*Attest:*

Bruce Lehman

BRUCE LEHMAN

*Attesting Officer*

*Commissioner of Patents and Trademarks*